US005964094A

United States Patent [19]

Butler et al.

[11] Patent Number: 5,964,094

[45] Date of Patent: Oct. 12, 1999

[54] METHOD AND APPARATUS FOR MIXING LIQUEFIED GASES

[75] Inventors: Niccola Butler, Worthing; Catharine Sarah Paige, Ascot; Michael Ernest Garrett, Woking, all of United Kingdom

[73] Assignee: The BOC Group plc, Windlesham, United Kingdom

[21] Appl. No.: 09/129,484

[22] Filed: Aug. 4, 1998

[30] Foreign Application Priority Data

Aug. 5, 1997 [GB] United Kingdom ..... 9716518

[51] Int. Cl.[6] ..... F17C 11/00; B05B 7/12

[52] U.S. Cl. ..... 62/46.1; 62/49.1; 137/630.16; 239/417.5

[58] Field of Search ..... 62/46.1, 46.2, 62/49.1; 137/896, 630.16, 602, 628, 561 R; 239/471.5

[56] References Cited

U.S. PATENT DOCUMENTS

| | | | |
|---|---|---|---|
| 2,018,835 | 10/1935 | Clark | 62/49.1 |
| 3,092,972 | 6/1963 | Poorman et al. | 62/46.1 |
| 3,717,006 | 2/1973 | Kimmel et al. | 62/46.1 |
| 5,697,228 | 12/1997 | Paige | 62/615 |
| 5,778,678 | 7/1998 | Lee | 62/46.1 |

FOREIGN PATENT DOCUMENTS

| | | | |
|---|---|---|---|
| 135698 | 6/1988 | Japan | 62/46.1 |

*Primary Examiner*—William Doerrler
*Attorney, Agent, or Firm*—David M. Rosenblum; Salvatore P. Pace

[57] ABSTRACT

A method of and apparatus for mixing two cryogenic liquids in which a first amount of first cryogenic liquid is introduced into a vented vessel having one or more vents. The vent or vents are then closed and a second amount of a second cryogenic level is introduced into the closed vessel at a level above the surface of the first cryogenic liquid in the vessel. The second cryogenic liquid has a greater density or both a greater density and a higher boiling point temperature than that of the first cryogenic liquid, thereby to produce a substantially homogeneous cryogenic liquid mixture of predetermined composition.

14 Claims, 1 Drawing Sheet

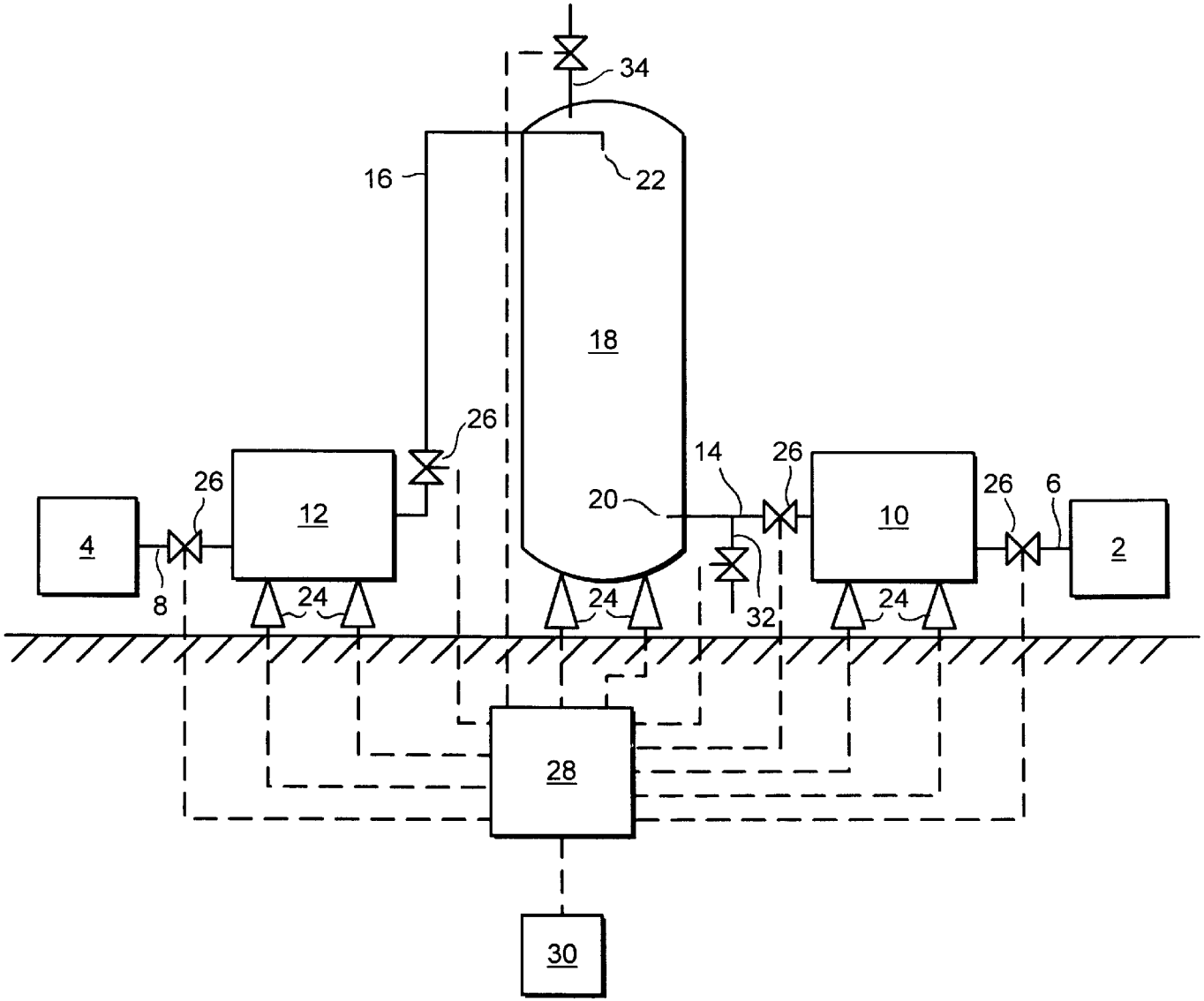
2
6
26
10
24
26
32
14
34
22
18
20
24
28
30
26
16
12
24
26
8
4

METHOD AND APPARATUS FOR MIXING LIQUEFIED GASES

This invention relates to the manufacture of liquefied gas mixtures, and relates particularly but not exclusively to the manufacture of respirable, life-supporting gas mixtures comprising two components, oxygen and nitrogen.

The Applicants' own earlier European Patent Application, No. 657107, discloses liquefied, or cryogenic, gas mixtures comprising liquid oxygen and liquid nitrogen which mixtures, when fully vaporised, have an oxygen concentration of between 15% and 22%, the remaining concentration being substantially of nitrogen. Such gas mixtures, which are sold by the Applicants under their Trade Mark "SLA", are breathable and (as they contain less oxygen than ambient air) reduce the risk of fire, and have many applications, such as food freezing and refrigeration.

The manufacture of such cryogenic gas mixtures in commercial quantities has heretofore mainly been achieved using continuous, in-line mixing techniques, comprising mixing the components either when both are in the liquid state or when both are in the gaseous state. Batch mixing has not been preferred due to fears of inaccuracy in the mixture composition and of ensuring that adequate mixing has taken place.

In-line mixing of two or more cryogenic liquids presents several difficulties. Firstly, the cryogenic liquids are particularly volatile, and the mixing process encourages a proportion of at least one of the liquefied gases to "flash off", or vaporise. This makes it difficult to establish accurately the composition of the liquid mixture. Furthermore, since it is usual to transport gases in the liquid state, there is a problem with what to do with the vaporised gas mixture which is of uncertain composition. Lastly, there is an occasional problem, particularly at low mixing rates, of contamination, whereby some of one of the components can contaminate the upstream source(s) of the other component(s). To an extent, in-line mixing of gases in the gaseous state (as is described in our own earlier European Patent Application, No. 774634, for example) does address the "flash off" problem met when mixing the gases in the liquid state, but it also introduces the problem of ensuring complete mixing. It is also unattractive due to the inconvenience and expense of having to liquefy the mixture before it can be transported over any appreciable distance. Moreover, the risk of upstream contamination of the gas sources is increased in an in-line mixing system in which the mixing is carried out in the gaseous state.

SUMMARY OF THE INVENTION

Accordingly, the present invention provides a method of mixing at least two cryogenic liquids comprising introducing a first predetermined amount of a first cryogenic liquid into a vessel which is selectively ventable to atmosphere but otherwise closed, and introducing a second predetermined amount of a second cryogenic liquid into the substantially closed vessel at a level above the surface of the first cryogenic liquid in the vessel, the second cryogenic liquid being of greater density or of greater density and having a higher boiling point temperature than the first cryogenic liquid, thereby to produce a substantially homogeneous cryogenic liquid mixture of predetermined composition.

We have found that such a method can produce a cryogenic liquid mixture in commercial quantities (albeit using a non-continuous process) which is both completely mixed and also of accurate composition; the effect of introducing (by "pouring" or "dripping") the denser cryogenic liquid into the lighter cryogenic liquid from above creates turbulence which, in addition to any turbulence or lasting liquid circulation created through the introduction of the first liquid, acts thoroughly to mix the two cryogenic liquids whilst simultaneously and advantageously eliminating or at least delaying the known, deleterious stratification of the cryogenic mixture in the vessel. Moreover, whilst some of the liquid vaporises on introduction of the second liquid, the turbulence existing within the closed vessel after the introduction of the second liquid is completed encourages vaporisation in a predictable manner until the gas/liquid mixture stabilises. Vaporisation is particularly predictable and the resulting mixture more stable where the second, denser cryogen has a higher boiling point temperature than the first, lighter cryogen, the differences in density and boiling point temperature/specific heat capacity of the two cryogens combining to optimise mixing and to ensure that the majority of the liquid which vaporises during mixing is of the first cryogen. The liquid mixture can then be analysed to check its composition and, if necessary this can be finely adjusted, preferably by adding more of the denser second liquid cryogen. Fine adjustment of the liquid mixture composition is also possible due to the selective vent means. Not only are vent means desirable for the relief of excess vapour pressure, which can occur during a mixing cycle, but also vent means are most advantageous for allowing vapour of known composition to vent to atmosphere; this encourages further vaporisation of the liquid mixture. Since the components of the liquid mixture have different volatilities, this further vaporisation tends to be of the more volatile cryogen, thus there occurs enrichment of the mixture with the less volatile cryogen.

The first cryogenic liquid is preferably introduced into the vessel, which has previously been precooled by the introduction of a small amount of the first liquid, at or adjacent the lowermost portion thereof, so as to promote some circulation but not so as to encourage vaporisation of the first liquid. If the pressure within the mixing vessel is not too great following the introduction of the first cryogenic liquid, then preferably the or each vent is closed before the introduction of the second cryogenic liquid.

The second cryogenic liquid is preferably introduced into the vessel from a point substantially above the level of the surface of the first cryogenic liquid in the vessel, at least about 0.5 m and preferably more than about 1 m, to promote cryogen circulation and therefore complete mixing. Ideally the second cryogenic liquid is introduced into the vessel from a point at or adjacent the uppermost portion thereof, so as to maximise turbulence and hence mixing. Maximising the vertical distance between the inlets for the first and second cryogenic liquids into the vessel also increases the inherent safety, by decreasing the possibility of an operator introducing the first cryogen through the inlet for the second cryogen, or vice versa.

The first and second predetermined amounts of the first and second cryogenic liquids, which amounts can relatively easily be determined theoretically, may be established by weighing the cryogenic liquids introduced into the vessel. This may easily be achieved by providing load cells adapted to measure the weight of the mixing vessel and its contents before, during and after the introduction of each cryogenic liquid thereinto. For a coarse determination, the amount of the or each cryogenic liquid to be introduced into the vessel can be established by passing the liquids through holding tanks, each equipped with means to weigh the tank and its contents, or by introducing cryogenic liquid flow meters (such as that disclosed in the Applicants' own earlier European Patent Application, No. 667510) in the cryogen supply lines. Holding tanks may be preferred, as they provide an inherently more effective defence against upstream contamination of a source of one cryogen by the other. In any event, the composition of the liquid mixture is probably less measured by withdrawing and analysing a sample of the mixed liquid. Where the mixture is found to be overly-rich in terms of the concentration of the more volatile (ie higher density, lower specific boiling point) component, this can be addressed by venting vapour from the mixing vessel to atmosphere; the reduction in pressure encourages vaporisation of the liquid mixture in the vessel, which vaporisation is principally of the more volatile component, thus enriching the liquid mixture in its concentration of the less volatile component. In this way, the mixture composition can be substantially and accurately enriched in the second, less volatile component.

We have found that the method of mixing in accordance with the present invention can reliably and repeatably produce liquid mixtures comprising two or more liquefied, substantially pure gases. In particular, we have found that the present method is ideally suited for batch production of liquid mixtures of oxygen and nitrogen having very accurately-controlled composition. It is believed that the principles of this invention are equally applicable to other liquid gas mixtures, such as the gas mixture comprising 2.5% carbon dioxide in argon used for shielding during certain welding processes, or the mixture of argon, nitrogen, oxygen and carbon dioxide used for firefighting (since, at present, this particular mixture is only provided in gaseous form, the present invention possibly presents the additional advantages of enabling such mixtures to be produced and transported to the point of use in liquid form).

In a second aspect, the invention also comprises apparatus for mixing two cryogenic liquids in accordance with any preceding Claim comprising an insulated cryogenic liquid mixing vessel, means for supplying liquid nitrogen and liquid oxygen thereto from sources thereof and including liquid nitrogen and liquid oxygen outlets within the vessel, the or each liquid oxygen outlet being positioned at or adjacent the uppermost portion of the vessel, vent means for selective relief to atmosphere of vapour pressure within the vessel and load cell means adapted to measure the weight of the vessel and its contents. Preferably the vent means are adapted to vent vapour from the vessel to atmosphere.

In preferred embodiments, the apparatus comprises preprogrammed interlock means for monitoring all stages of the mixing process including the step of supplying the cryogenic liquid mixture, the interlock means being responsive to inputs from an operator and adapted mechanically to prevent or to facilitate the progress of the mixing process at any stage according to the pre-programming. The pre-programming is suitably designed to ensure that the proper mixing procedures are followed, so that an operator cannot, whether inadvertently or intentionally, compromise safety. The interlock means preferably comprise mechanical interlocks which an operator must actuate manually in a predetermined order, as an added guarantee that the correct procedure is followed.

BRIEF DESCRIPTION OF THE DRAWINGS

The invention will now be described by way of examples and by reference to the accompanying exemplary drawing, which is a simplified schematic diagram of an apparatus, in accordance with the invention, for mixing liquid oxygen with liquid nitrogen.

DETAILED DESCRIPTION

In the apparatus illustrated, bulk liquid nitrogen and liquid oxygen sources 2, 4 are connected by lines 6, 8 to intermediate, thermally-insulated holding vessels 10, 12 (which are useful as break tanks, so as to prevent contamination of the bulk sources, as pressure raising vessels and, when required, for dumping their contents). Holding vessels 10, 12 are connected by lines 14, 16 to thermally-insulated mixing vessel 18, the outlet 20 of liquid nitrogen supply line 14 being located towards the bottom of mixing vessel 18 and the outlet 22 of liquid oxygen supply line 16 being located towards the top of mixing vessel 18.

Whilst the precise location of liquid nitrogen outlet 20 is not critical, liquid oxygen outlet 22 must be located above the highest expected surface level of liquid nitrogen within mixing vessel 18, and outlet 22 is therefore conveniently located adjacent the top of the mixing vessel 18.

Holding vessels 10, 12 and mixing vessel 18 are all supported by load cells 24, and a valve 26 is located in each of supply lines 6, 8, 14, 16. A controller 28, such as an appropriately-programmed computer, with a manual operator interface 30, is operatively connected so as to actuate valves 26 in order to effect the batch mixing of liquid nitrogen and liquid oxygen, according to the process described below, and responsive to signals from load cells 24.

Not shown in the drawing for reasons of clarity are: an analysis line with a restricting device located towards the bottom of mixing vessel 18, for drawing off a sample amount of liquid and vaporising it in order to analyse the composition of the contents of the mixing vessel (and connected to the controller 28, and/or for manual operation); vent valves in each of the holding vessels 10, 12 for relieving excess pressure therein, and, in each of holding vessels 10, 12 and mixing vessel 18: a nozzle for dumping liquid; a circuit for raising the pressure therein, and pressure or pressure and temperature sensors (each of which elements may be operatively connected to the controller 28).

Line 14 is provided with a branch line 32 (containing a valve 26 operatively connected to controller 28) for dispensing (or dumping) the contents of mixing vessel 18.

Vent means 34, which are preferably automated and controllable by controller 28, are provided towards the top of mixing vessel 18 for the selective relief of vapour pressure therein. This pressure relief is achieved by venting vapour to atmosphere, which is desirable to prevent excessive vapour pressure building up within the mixing vessel 18 during a mixing cycle, and is also advantageous for adjusting (enriching) the oxygen concentration in the mixed liquid.

The steps involved in producing a batch of mixed liquid nitrogen and liquid oxygen, which may be carried out using the illustrated apparatus, will now be described.

The first step involves setting batch targets. A target analysis of the mixed liquid J is established, in terms of percentage oxygen by volume (% vol. $O_2$) and from this is calculated a target analysis of the percentage oxygen content of the mixed liquid, K, according to the equation:

$$K = \frac{(800 \times J)}{(700 + J)} \ \% \text{ wt } O_2 \tag{1}$$

Also a target batch weight, L kg, is established, which must of course not exceed the capacity of the mixing vessel 19.

Having checked that there is no residual liquid present in the mixing vessel 18 and that its interior is at the appropriate pressure and temperature (ie pre-cooled to cryogenic temperature), the process of filling the mixing vessel 18 with liquid nitrogen can commence.

The target weight of nitrogen to be introduced into mixing vessel 18, M kg, can be calculated according to the equation:

$$M = \frac{L(100-K)}{100} \text{ kg} \tag{2}$$

This mass of liquid nitrogen is introduced into the mixing vessel 18 via outlet 20 in such a way as not to promote excessive vaporisation, and the resulting actual quantity of nitrogen in the mixing vessel, M' kg, is established from the load cell readings (M' usually being somewhat less than M due to the effects of vaporisation and other losses in the holding tank 10, mixing vessel 18 and line 26).

Once the actual weight, M' kg, of liquid nitrogen in the mixing vessel 18 is established, the process of adding the liquid oxygen can begin.

The purity of the oxygen to be added (which normally should be more than 95%) in terms of percentage oxygen by weight of the oxygen in source 4 is measured and converted to a purity by weight figure N (% wt $O_2$).

The target quantity of liquid oxygen by weight, P, to be added to the mixing vessel is calculated according to the equation:

$$P = \frac{J}{100-J} \times M' \text{ kg} \tag{3}$$

This weight of liquid oxygen is supplied to the holding vessel 12 and thence to the mixing vessel 18, the weight of liquid oxygen, P', mixed with the liquid nitrogen being measured by the load cells (P' being different to P because of vaporisation and other losses).

Because the liquid oxygen is introduced into the mixing vessel 18 above the surface level of the liquid nitrogen therein, and since the oxygen is denser than the nitrogen, there is effective mixing without stratification, as described above. There is, however, some flashing off, principally of the lighter, lower boiling point temperature/lower specific heat capacity liquid nitrogen during the mixing process. The actual quantity of liquid oxygen in the mixed liquid after mixing losses, P" kg, is calculated by the equation:

$$P'' = \frac{P' \times N}{100} \text{ kg} \tag{4}$$

and the actual quantity of liquid nitrogen in the mixed liquid, M" kg, comes from the equation:

$$M'' = M' + P' - \frac{P' \times N}{100} \text{ kg} \tag{5}$$

The analysis of the mixed batch is calculated, as a percentage oxygen by weight, Q, according to the equation:

$$Q = \frac{P''}{M'' + P''} \times 100 \text{ \% wt } O_2 \tag{6}$$

and converted to a percentage oxygen by volume, R, by the equation:

$$R = \frac{700 \times Q}{800 - Q} \text{ \% vol. } O_2 \tag{7}$$

This figure is confirmed by actual analysis of the composition (percentage oxygen by volume) of the mixed liquid within mixing vessel 18, which is measured no sooner than about 30 minutes after the liquid oxygen has been added, and the measurement repeated after a further 5 minutes to ensure that the reading has stabilised (fluctuating readings may indicate that the sample measured has not fully vaporised). The composition is analysed by drawing off a sample amount of the mixed liquid from the mixing vessel via an analysis line having a restricting device adapted to allow the sample to vaporise fully so that its composition can be analysed as is well-known in the art. Measurements close to 21% must be viewed with caution, as the analysis apparatus may simply be analysing ambient air rather than the mixed cryogenic liquid. Once the composition of the mixed liquid has been determined, if it is significantly removed from the desired composition this may be corrected; if the mixture is oxygen-poor this is a simple matter of calculating the further amount of oxygen required and introducing this to the mixture as set out above. Alternatively, the composition may be enriched by venting gas from the mixing vessel. If the mixture is oxygen-rich, it might be possible to adjust by adding more liquid nitrogen, but because this has to be introduced into the liquid mixture, which can promote stratification and excess vaporisation, this has to be done with extreme care.

The following examples are illustrative of typical parameters encountered during production, in accordance with the invention, of a liquid mixture of oxygen and nitrogen having a composition between 16.5% and 21% by volume oxygen (this range being found to produce a vaporised gas which, at the point of use, has a composition of between about 17% and about 22% by volume oxygen (there typically being oxygen enrichment of the mixture during transport and storage of about 1 to 1.5%), which is particularly suitable in food storage or freezing applications.

Bulk Liquid Oxygen Supply

- Pressure: 1.9 Barg (0.29 MPa approx.)
- Temperature: 90K
- Density: 1142 Kg/m$^3$ Oxygen Holding Vessel Values (as supplied to Mixing Vessel)

"Cold" Liquid—ie used immediately

- Pressure: 4.0 Barg (0.5 MPa approx.)
- Temperature: 95K (assuming some heat inleak when transferring between vessels)
- Density: 1118 Kg/m$^3$ "Warm" Liquid—ie at saturation

- Pressure: 4.0 Barg (0.5 MPa approx.)
- Temperature: 108.8K
- Density: 1042 Kg/m$^3$ Bulk Liquid Nitrogen Supply

- Pressure: 1.9 Barg (0.29 MPa approx.)
- Temperature: 83K
- Density: 782 Kg/m$^3$ Nitrogen Values in Mixing Vessel before Oxygen Added (pressure reduced)

- Pressure: 1.0 Barg (0.2 Mpa approx.)
- Temperature: 84K
- Density: 779 Kg/m$^3$ Values for Oxygen/Nitrogen Mixtures (assume saturated and range 16.5 to 21% by volume) Oxygen

| | |
|---|---|
| Density Range: | |
| Composition: | 16.5% by vol. O2 |
| Pressure: | 4.0 Barg (0.5 MPa approx.) safety valve lifting pressure |
| Temperature: | 95.6K |
| Density: | 774 Kg/m$^3$ |
| Composition: | 21% by vol. O2 |
| Pressure: | 1.0 Barg (0.2 MPa approx.) lowest realistic pressure likely to be seen |
| Temperature: | 85.3K |
| Density: | 844 Kg/m$^3$ |
| Temperature Range: | |
| Composition: | 16.5% by vol. O2 |
| Pressure: | 1.0 Barg (0.2 MPa approx.) lowest realistic pressure likely to be seen |
| Temperature: | 84.9K |
| Density: | 830 Kg/m$^3$ |
| Composition: | 21% by vol. O2 |
| Pressure: | 4.0 Barg (0.5 MPa approx.) safety valve lifting pressure |
| Temperature: | 96.0K |
| Density: | 788.5 Kg/m$^3$ |
| Typical Values: In Mixing Vessel | |
| Composition: | 17.5% by vol. O2 |
| Pressure: | 3.0 Barg (0.4 MPa approx.) |
| Temperature: | 92.8K |
| Density: | 793 Kg/m$^3$ |
| In Customer Storage Vessel | |
| Composition: | 20.0% by vol. O2 |
| Pressure: | 4.0 Barg (0.5 MPa approx.) |
| Temperature: | 95.9K |
| Density: | 785 Kg/m$^3$ |
| Typical Mixing Process: | |
| 37.03 Tonne Nitrogen | |
| Pressure: | 1.0 Barg (0.2 MPa approx.) |
| Temperature: | 84K |
| Density: | 779 Kg/m$^3$ |
| 8.97 Tonne Oxygen | |
| Pressure: | 3.0 Barg (0.4 MPa approx.) |
| Temperature: | 105.8K |
| Density: | 1059 Kg/m$^3$ |

From the above examples and description, those skilled in the art will appreciate various modifications and improvements to the invention which are still within the scope of the following claims. For example: an intermediate holding tank for one or more of the liquid gases is desirable but not essential; although the Figure shows each tank having two load cells for weighing each tank and its contents, arrangements with more or less than two load cells can be used, and the bulk liquid cryogen sources, although described implicitly as storage tanks, could equally comprise liquid cryogen transporters (ie tankers), although when using tankers the mixing process described above needs modification in order to take account of the limited capacity of such tankers and the variability of the temperature, pressure and density of their contents.

Finally, to avoid misapprehension, whenever the words "comprises" or "comprising" are employed herein, in the description, claims or abstract, they are not to be construed as comprehensive or exhaustive; that is to say, the words are always to be read and construed as if preceded by the term "inter alia".

We claim:

1. A method of mixing at least two cryogenic liquids comprising:

introducing a first predetermined amount of a first cryogenic liquid into a vessel which is selectively ventable to atmosphere but otherwise closed;

introducing a second predetermined amount of a second cryogenic liquid into the substantially closed vessel at a level above the surface of the first cryogenic liquid in the vessel;

the second cryogenic liquid being of greater density than the first cryogenic liquid, thereby to produce a substantially homogeneous cryogenic liquid mixture of predetermined composition; and allowing a sufficient period of time to elapse from completing the introduction of the second cryogenic liquid into the vessel for the cryogenic liquids to mix thoroughly before tapping cryogenic liquid mixture from the vessel.

2. The method according to claim 1 wherein the first cryogenic liquid is introduced into the vessel at or adjacent the lowermost portion thereof.

3. The method according to claim 1 or claim 2 wherein the second cryogenic liquid is introduced into the vessel from a point at least about 0.5 m above the level of the surface of the first cryogenic liquid in the vessel.

4. The method according to claim 3 wherein the second cryogenic liquid is introduced into the vessel from a point at least about 1 m above the level of the surface of the first cryogenic liquid in the vessel.

5. The method according to claim 1 wherein the second cryogenic liquid is introduced into the vessel at or adjacent the uppermost portion thereof.

6. The method according to claim 1 wherein the first and second predetermined amounts are established by weighing the cryogenic liquids introduced into the vessel.

7. The method according to claim 6 comprising weighing the vessel before and after the introduction of each cryogenic liquid thereinto.

8. The method according to claim 6 or claim 7 comprising weighing the vessel during the introduction of the or each cryogenic liquid thereinto.

9. The method according to claim 1 wherein each of the cryogenic liquids introduced into the vessel is a liquefied, substantially pure gas.

10. The method according to claim 9 wherein the first cryogenic liquid is liquefied nitrogen.

11. The method according to claim 9 or claim 10 wherein the second cryogenic liquid is liquefied oxygen.

12. The method according to claim 1 wherein the said period of time is at least 30 minutes.

13. The method according to claim 1 comprising tapping cryogenic liquid mixture from the vessel for analysis of the composition of the mixture.

14. The method according to claim 1 comprising closing the or each vent after the introduction of the first cryogenic liquid and before introduction of the second cryogenic liquid.

* * * * *